US006796773B1

(12) United States Patent
Choi et al.

(10) Patent No.: US 6,796,773 B1
(45) Date of Patent: Sep. 28, 2004

(54) VARIABLE CAPACITY ROTARY COMPRESSOR

(75) Inventors: Jin Kyu Choi, Suwon (KR); Seung Kap Lee, Suwon (KR); Cheol Woo Kim, Seongnam (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/733,238

(22) Filed: Dec. 12, 2003

(30) Foreign Application Priority Data

May 21, 2003 (KR) ..... 2003-32287

(51) Int. Cl.[7] ..... F04B 49/00; F04C 23/00

(52) U.S. Cl. ..... 417/218; 417/221; 417/287; 417/298; 417/410.3; 418/60

(58) Field of Search ..... 417/218, 221, 417/287, 298, 326, 410.3; 418/29, 57, 60, 69

(56) References Cited

U.S. PATENT DOCUMENTS

| | | | | |
|---|---|---|---|---|
| 1,789,842 A | * | 1/1931 | Rolaff | 418/57 |
| 4,397,618 A | | 8/1983 | Stenzel | 418/23 |
| 4,780,067 A | * | 10/1988 | Suzuki et al. | 417/410.3 |

FOREIGN PATENT DOCUMENTS

| | | | | |
|---|---|---|---|---|
| JP | 62-70686 | * | 4/1987 | 418/60 |
| JP | 63-57889 | * | 3/1988 | 418/60 |
| WO | 93/11358 | * | 6/1993 | 418/57 |

* cited by examiner

*Primary Examiner*—John J. Vrablik
(74) *Attorney, Agent, or Firm*—Staas & Halsey LLP

(57) ABSTRACT

A variable capacity rotary compressor, which precisely controls variation of a compression capability into a desired discharge pressure, and which minimizes a resistance to rotation of a rotating shaft, and thus improves the capacity of the rotary compressor. The rotary compressor includes, a hermetic casing, a housing, disposed in the hermetic casing, having two compressing chambers having different capacities, a rotating shaft rotatably disposed in the two compressing chambers, two eccentric units mounted on the rotating shaft in the two compressing chambers, the two eccentric units being operated in opposite manners such that when either one of the two eccentric units is locked in an eccentric state to perform a compressing operation, the other eccentric unit is released from the eccentric state to release the compressing operation, two roller pistons fitted on outer surfaces of the first and second eccentric units, two vanes provided in the two compressing chambers to be radially moved while being in contact with the first and second roller pistons, and a pressure control unit to allow a discharging pressure to be applied to either one of the two compressing chambers, where an idle rotating operation is performed.

30 Claims, 11 Drawing Sheets

VARIABLE CAPACITY ROTARY COMPRESSOR

CROSS-REFERENCE TO RELATED APPLICATIONS

This application claims the benefit of Korean Application No. 2003-32287, filed May 21, 2003, in the Korean Intellectual Property Office, the disclosure of which is incorporated herein by reference.

BACKGROUND OF THE INVENTION

1. Field of the Invention

The present invention relates to a rotary compressor, and more particularly, to a variable capacity rotary compressor capable of varying compression capacity of a refrigerant.

2. Description of the Related Art

In recent years, refrigeration systems, used in air conditioners or refrigerators, usually include a variable capacity rotary compressor, which is designed to allow variation of a compression capability of refrigerant in order to achieve an optimal refrigeration capability, thus meeting requirements and saving energy.

U.S. Pat. No. 4,397,618 discloses a variable capacity rotary compressor, which is adapted to control a compression capability thereof by locking or releasing a vane. The variable capacity rotary compressor includes a casing having a cylindrical compressing chamber therein, and a rolling piston disposed in the compressing chamber of the casing to be eccentrically rotated. The casing is provided with a vane, which is radially movable back and forth while being in contact with an outer surface of the rolling piston. Adjacent to the vane, a locking unit including a ratchet bolt, an armature and a solenoid is provided to control a compression capability of the rotary compressor by locking or releasing actuation of the vane. More specifically, the vane is locked or released by the ratchet bolt which is moved back and forth by the solenoid, thereby varying a compression capability of the rotary compressor.

However, since the above variable capability rotary compressor is constructed to control a compression capability in such a way that a compressing operation is blocked by locking the vane for a certain period and the compressing operation is allowed by releasing the vane for a certain period, it is difficult to vary a compression capability into a desired discharge pressure.

SUMMARY OF THE INVENTION

Accordingly, an aspect of the present invention provides a variable capability rotary compressor, which can easily perform and precisely control the variation of a compression capability into a desired discharge pressure.

It is another aspect of the present invention to provide a variable capability rotary compressor, which is designed to minimize resistance to rotation so as to enhance a compression capability thereof.

The foregoing and/or other aspects of the present invention are achieved by providing a variable capacity rotary compressor, including a hermetic casing, a housing disposed in the hermetic casing and including first and second compressing chambers having different capacities, a rotating shaft rotatably disposed in the first and second compressing chambers, first and second eccentric units mounted on an outer surface of the rotating shaft in the first and second compressing chambers, the first and second eccentric units being operated in opposite manners such that when either the first or second eccentric unit is locked in an eccentric state to perform a compressing operation, the other eccentric unit is released from the eccentric state to release the compressing operation, first and second roller pistons fitted on outer surfaces of the first and second eccentric units, respectively, first and second vanes provided in the first and second compressing chambers to be radially moved while being in contact with the first and second roller pistons, respectively, and a pressure control unit to allow a discharging pressure to be applied to either the first or second compressing chamber, where an idle rotating operation is performed.

The pressure control unit may include first and second flow paths communicating with the first and second compressing chambers to allow a discharging pressure to be applied to either the first or second compressing chamber, where an idle rotating operation is performed, and first and second valves provided at the first and second flow paths to open and close the flow paths.

The pressure control unit may include a connecting pipe provided outside the hermetic casing to communicate with an inside of the hermetic casing, and wherein the first and second flow paths are defined by first and second branch pipes diverging from the connecting pipe, the first and second valves being provided at the first and second branch pipes.

The pressure control unit may include a connecting pipe provided outside the hermetic casing to communicate with an inside of the hermetic casing, first and second branch pipes diverging from the connecting pipe and communicating with the first and second compressing chambers, and a three-way valve provided at a diverging point where the first and second branch pipes diverge from the connecting pipe.

The housing may include an intermediate plate to isolate the first and second compressing chambers from each other, and the pressure control unit may include a path-diverting chamber formed in the intermediate plate and having first and second through-holes communicating with the first and second compressing chambers, a communicating path to allow an inside of the hermetic casing to communicate with the path-diverting chamber, and a valve piece disposed in the path-diverting chamber and operated by a pressure difference between the first and second compressing chambers to close either the first or second through-hole where a compressing operation is performed while opening the other through-hole.

The communicating path may include a connecting pipe extended from the hermetic casing to communicate with an inside of the hermetic casing, and a flow path radially formed in the intermediate plate to be connected between the path-diverting chamber and the connecting pipe.

The first and second through-holes of the path-diverting chamber may be provided at a position opposite to the first and second vanes.

Diameters of the path-diverting chamber and the valve piece may be larger than those of the upper and lower through-holes so as to enable the valve piece to close the upper and lower through-holes.

The valve piece may be made of a thin resilient plate.

The variable capacity rotary compressor may further include a path-diverting unit to allow refrigerant to be drawn into either one of inlet ports of the first and second compressing chambers, where a compressing operation is performed.

The path-diverting unit may include a hollow body, having a predetermined length, closed at opposite ends thereof, an inlet opening provided at the center of the hollow body, first and second outlet openings provided at the side opposite to the inlet opening with a spacing therebetween, and communicating with the inlet ports of the first and second compressing chambers, respectively, a hollow valve seat disposed in the hollow body to communicate with the inlet opening and having opposite ends communicating with the first and second outlet openings, and first and second valve members movably disposed in the hollow body to close the opposite ends of the hollow valve seat, and connected to each other by a connecting member.

The first and second valve members may be moved toward either the first or second outlet opening, which has a pressure lower than that of the other outlet opening, due to a pressure difference between the first and second outlet opening, so that a corresponding first or second valve member closes one end of the valve seat adjacent to the other outlet opening with a higher pressure, thereby allowing the inlet opening of the hollow body to communicate with the one outlet opening with lower pressure.

Each of the first and second eccentric units may include an eccentric cam provided on the rotating shaft, an eccentric bush rotatably fitted on an outer surface of the eccentric cam, a corresponding one of the first and second roller pistons being fitted on an outer surface of the eccentric bush, and a stop unit to cause the eccentric bush to be maintained in an eccentric state or in a non-eccentric state.

The stop unit may include a first stop element projected from the eccentric cam, and a second stop element protruded from the eccentric bush to be caught by the first stop element.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
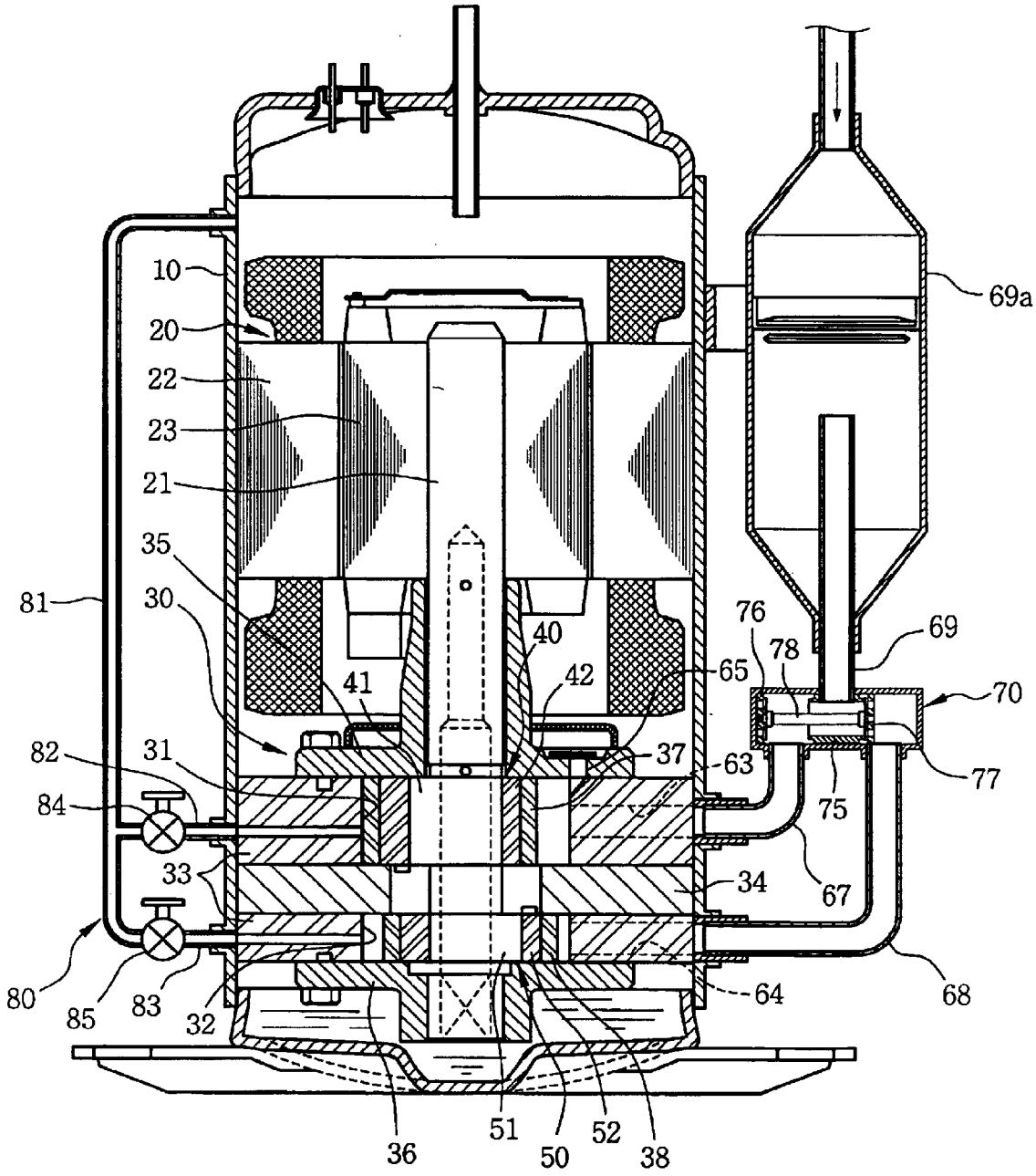
FIG. 1 is a longitudinal cross-sectional view of a variable capacity rotary compressor according to a first embodiment of the present invention.

Reference will now be made in detail to the present preferred embodiments of the present invention, examples of which are illustrated in the accompanying drawings, wherein like reference numerals refer to like elements throughout.

FIG. 1 shows a longitudinal cross-sectional view showing a variable capability rotary compressor according to a first embodiment of the present invention. The variable capability rotary compressor includes a hermetic casing 10, a drive unit 20 disposed in the hermetic casing 10 to generate a turning force, and a compressing unit 30 connected to the drive unit 20 via a rotating shaft 21.

The drive unit 20 includes a cylindrical stator 22 fixedly attached to an inner surface of the hermetic casing 10, and a rotator 23 rotatably disposed in the stator 22 and joined to the rotating shaft 21 at the center thereof. The drive unit 20 drives the rotating shaft 21 in forward and reverse directions.

The compressing unit 30 includes a housing 33, which is formed with a first upper cylindrical compressing chamber 31 and a second lower cylindrical compressing chamber 32, with the first and second compressing chambers 31 and 32 having different capacities. The housing 33 includes upper and lower flanges 35 and 36 to close an upper face of the first compressing chamber 31 and a lower face of the second compressing chamber 32 and to rotatably support the rotating shaft 21, and an intermediate plate 34 interposed between the first and second compressing chambers 31 and 32 to separate both compressing chambers from each other.

Figure 2:
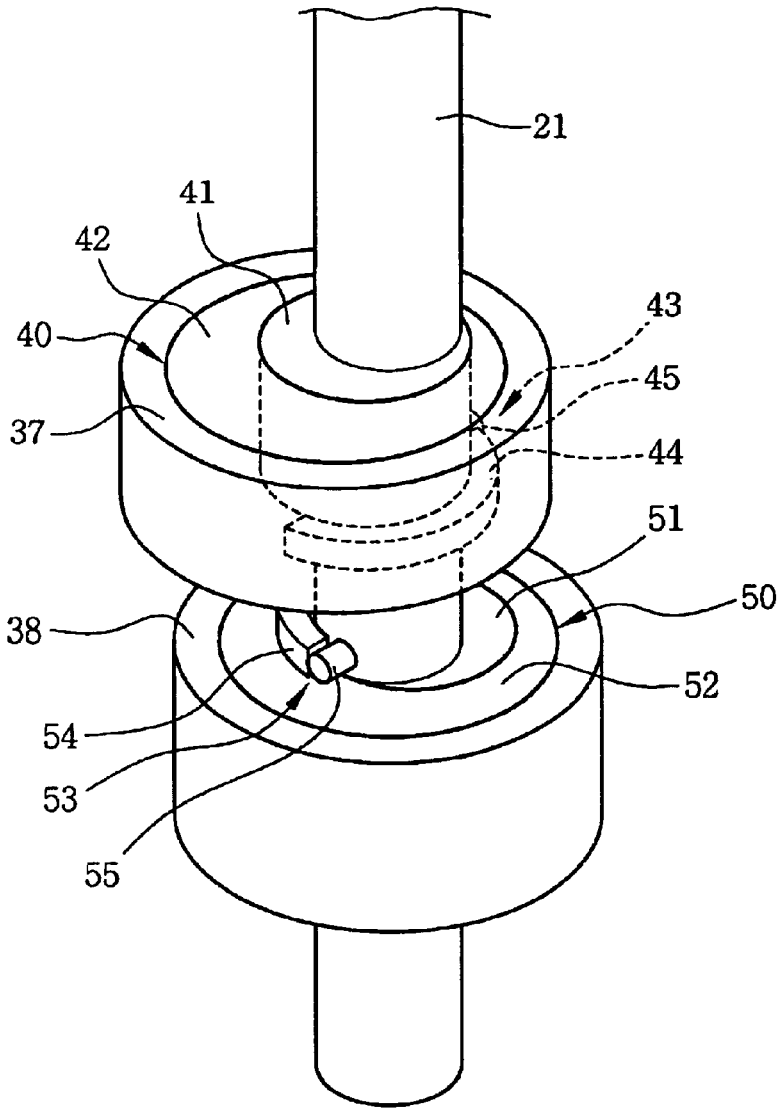
FIG. 2 is a perspective view of eccentric units of the variable capacity rotary compressor according to the present invention.
Figure 3:
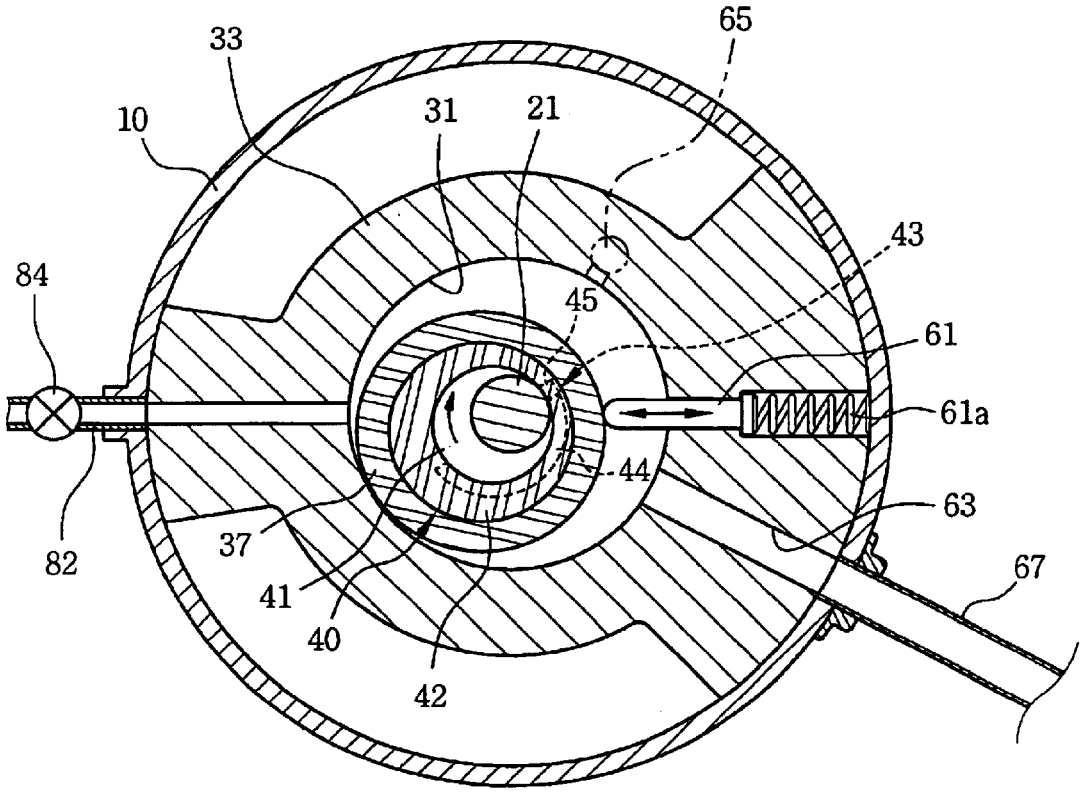
FIG. 3 is a cross-sectional view of the variable capacity rotary compressor according to the first embodiment of the present invention, in which a first compressing chamber performs a compressing operation while a rotating shaft is rotated in one direction.
Figure 4:
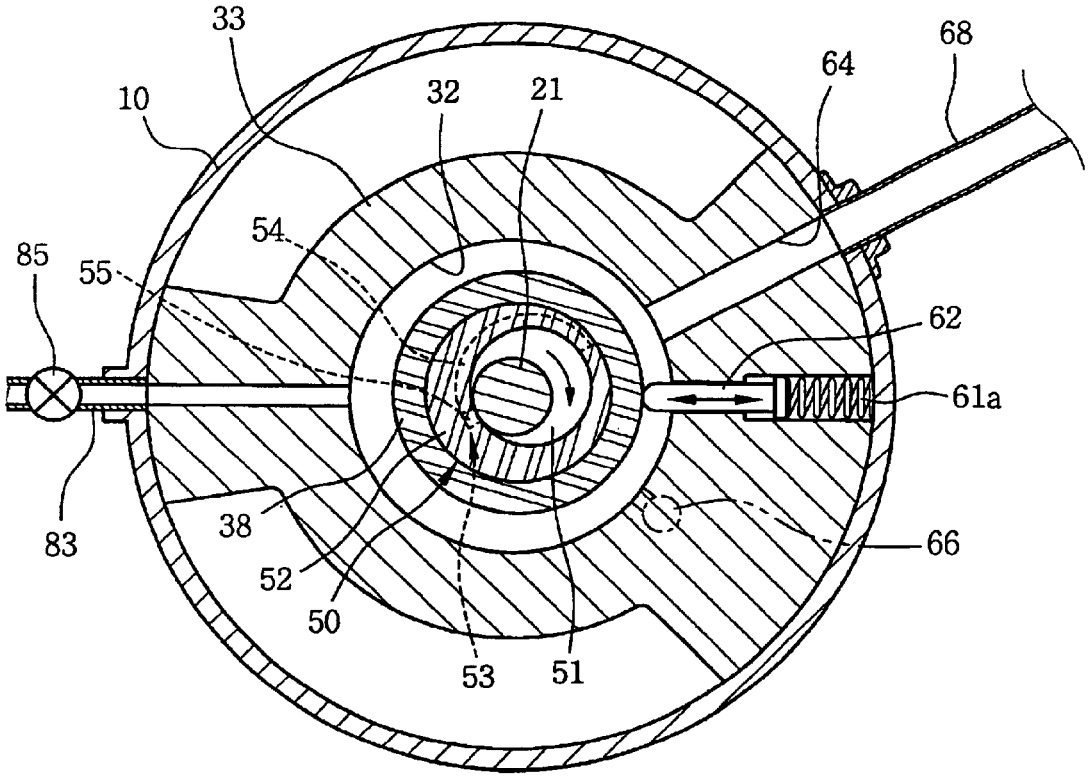
FIG. 4 is a cross-sectional view of the variable capacity rotary compressor shown in FIG. 3, in which a second compressing chamber performs an idle rotating operation while the rotating shaft is rotated in one direction.

As shown in FIGS. 2 to 4, the rotating shaft 21 is provided with first and second eccentric units 40 and 50 in the first and second compressing chambers 31 and 32. First and second roller pistons 37 and 38 are rotatably fitted on the outer surfaces of the first and second eccentric units 40 and 50, respectively. A first vane 61 is provided between an inlet port 63 and an outlet port 65 of the first compressing chamber 31 to be moved back and forth during a compressing operation while being in contact with an outer surface of the first roller piston 37, and a second vane 62 is provided between an inlet port 64 and an outlet port 66 of the second compressing chamber 32 to be moved back and forth to perform an compressing operation while being in contact with an outer surface of the second roller piston 38. Both the first and second vanes 61 and 62 are supported by the first and second vane springs 61*a* and 62*a*, respectively. The inlet ports 63 and 64 and the outlet ports 65 and 66 of the first and second compressing chambers 31 and 32 are positioned opposite to each other with reference to a corresponding vane 61 or 62.

The first and second eccentric units 40 and 50 include first and second eccentric cams 41 and 51, which are provided on an outer surface of the rotating shaft 21 at positions corresponding to the first and second compressing chambers 31 and 32, and first and second eccentric bushes 42 and 52 rotatably fitted on the outer surfaces of the first and: second eccentric cams 41 and 42. At this point, the first and second eccentric cams 41 and 51 are provided on the rotating shaft 21 to eccentrically protrude in substantially opposite directions to each other. The above-mentioned first and second roller pistons 37 and 38 are rotatably fitted on the first and second eccentric bushes 42 and 52, respectively.

The first and second eccentric unit 40 and 50 further include first and second stop units 43 and 53 so as to allow the first and second eccentric bushes 42 and 52 to rotate in an eccentric state or in a non-eccentric state depending on a rotating direction of the rotating shaft 21. The stop units 43 and 53 are comprised of stop protrusions 45 and 55 projected from the rotating shaft 21 or the eccentric cams 41 and 51, and stop ribs 44 and 54 which protrude from the first and second eccentric bushes 42 and 52 to have semicircular shapes and are caught by the stop protrusions 45 and 55. The stop unit 43 of the first eccentric unit 40 and the stop unit 53 of the second eccentric unit 50 are disposed at angular positions substantially opposite to each other so that any one of the first and second eccentric units 40 and 50 is released from the eccentric state when the other first or second eccentric unit 40 or 50 is eccentrically disposed by the rotation of the rotating shaft 21.

More specifically, when the rotating shaft 21 is rotated in one direction, the first eccentric bush 42 in the first compressing chamber 31 is rotated along with the rotating shaft 21 by the engagement of the stop protrusion 45 of the rotating shaft 21 and the stop rib 44 of the first eccentric bush 42 while in the eccentric state, as illustrated in FIG. 3. At this time, the second eccentric cam 51 is rotated along with the second eccentric bush 52 released from its eccentric state, by the engagement of the second stop unit 53, thereby permitting the roller piston 38 to be idly rotated without the compressing operation, as illustrated in FIG. 4.

Figure 5:
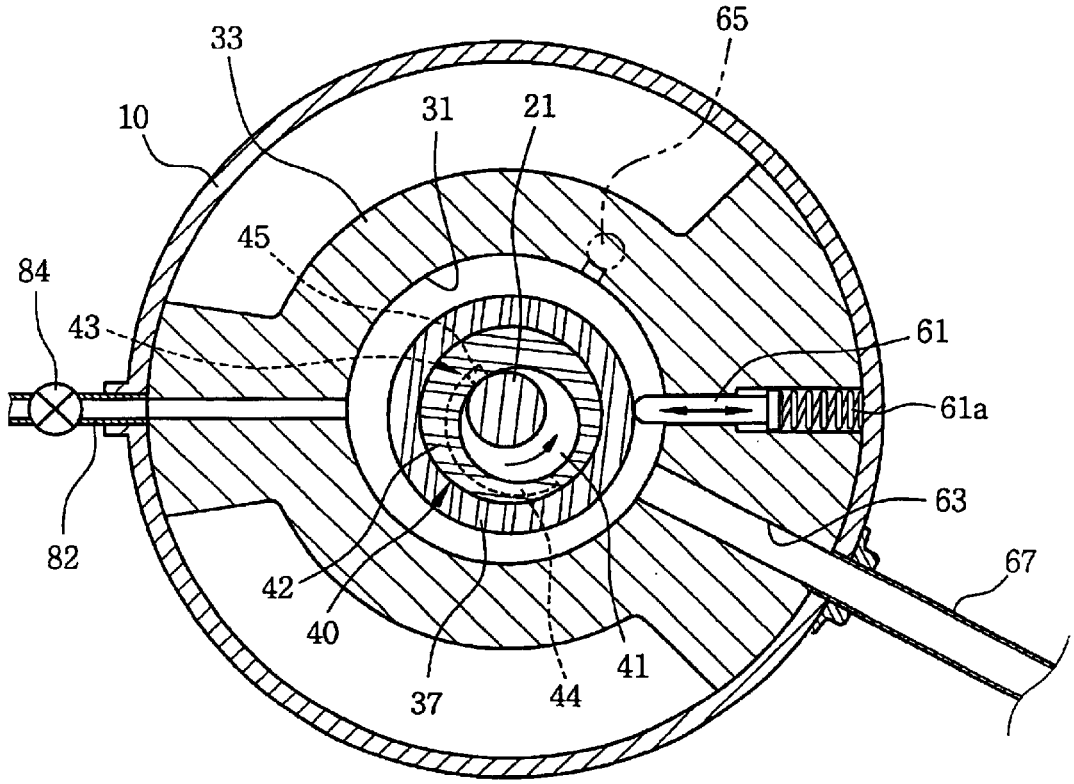
FIG. 5 is a cross-sectional view of the variable capacity rotary compressor shown in FIG. 3, in which a first compressing chamber performs an idle operating operation while the rotating shaft is rotated in a reverse direction.
Figure 6:
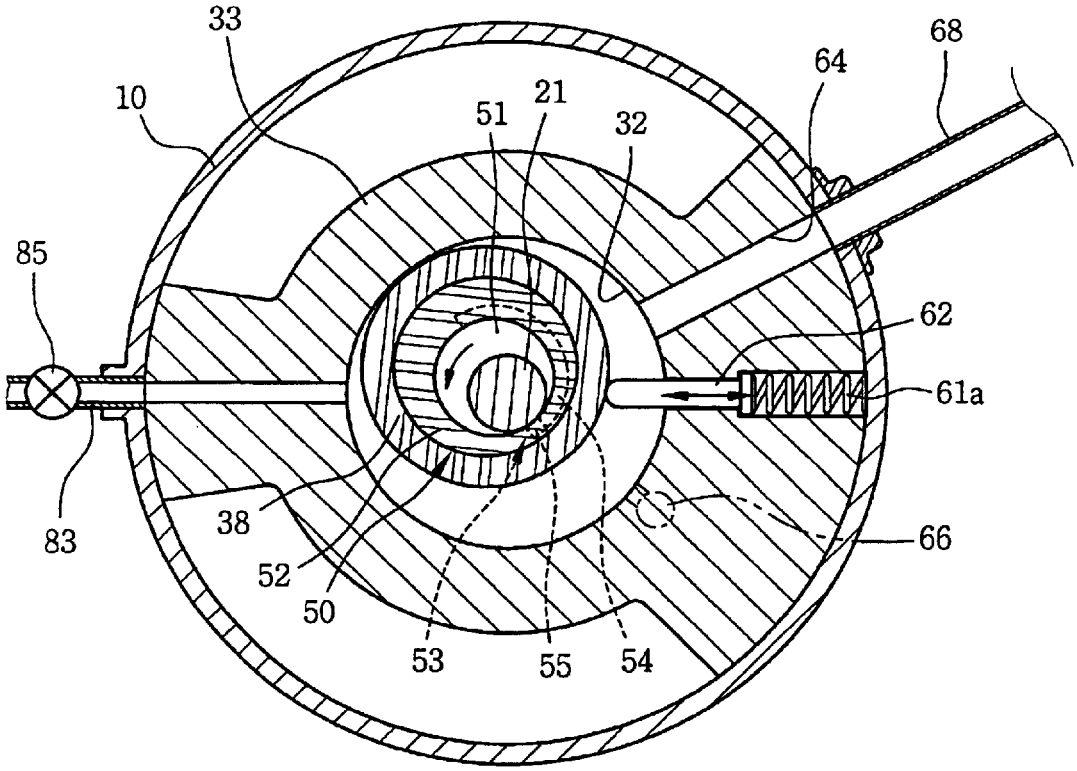
FIG. 6 is a cross-sectional view of the variable capacity rotary compressor shown in FIG. 3, in which a second compressing chamber performs a compressing operation while a rotating shaft is rotated in a reverse direction.

On the other hand, when the rotating shaft 21 is rotated in the direction opposite to the direction shown in FIGS. 3 and 4, the first eccentric bush 42 in the first compressing chamber 31 is released from its eccentric state, and thus there is no compressing operation in the first compressing chamber 31, as illustrated in FIGS. 5 and 6. At the same time, since the second eccentric bush 52 in the second compressing chamber 32 is rotated along with the second eccentric cam 51 while being disposed in its eccentric state, there is a compressing operation in the second compressing chamber 32.

According to the present invention, since a compressing operation is carried out in either the first or second compressing chamber 31 or 32 having different capacities, depending on a rotating direction of the rotating shaft 21, with the help of the first and second eccentric units 40 and 50, a variable capacity operation can be achieved by the simple change in a rotating direction of the rotating shaft 21, and variation of capacity into a desired discharge pressure can be easily achieved.

As shown in FIG. 1, the variable capacity rotary compressor according to the present invention further includes a path-diverting unit 70, which allows the refrigerant supplied to a suction pipe 69 from an accumulator 69*a*, to be drawn into only one of the inlet ports 63 of the first compressing chamber 31 and the inlet port 64 of the second compressing chamber 32, where a compressing operation is carried out.

Figure 7:
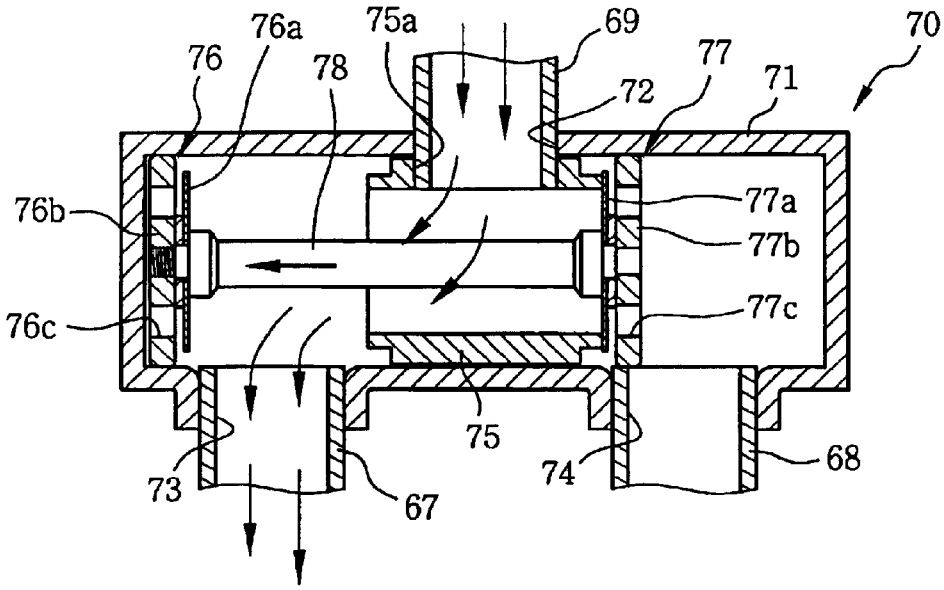
FIG. 7 is a cross-sectional view of path-diverting unit of the variable capacity rotary compressor according to the present invention, in which a first outlet opening is opened.
Figure 8:
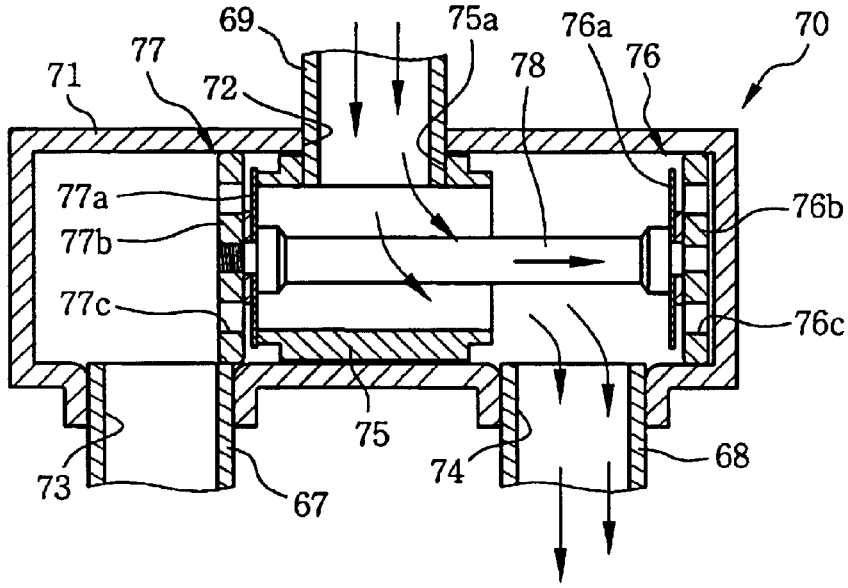
FIG. 8 is a cross-sectional view of path-diverting unit of the variable capacity rotary compressor according to the present invention, in which a second outlet opening is opened.

As shown in FIGS. 7 and 8, the path-diverting unit 70 includes a cylindrical hollow body 71 having a predetermined length and closed at both ends thereof. The hollow body 71 is provided at the center of an outer circumferential surface thereof with an inlet opening 72, which communicates with the suction pipe 69. The hollow body 71 is further provided at the side opposite to the inlet opening 72 with a pair of first and second outlet openings 73 and 74, which are spaced apart each other and communicate by the inlet port 63 of the first compressing chamber 31 and the inlet port 64 of the second compressing chamber 32, respectively.

In addition, the path-diverting unit 70 includes a cylindrical hollow valve seat 75 with both ends opened, first and second valve members 76 and 77 movably disposed in the hollow body 71 to open and close the opposite ends of the valve seat 75, and a connecting rod 78 connected between the first and second valve members 76 and 77 to be moved therewith. The valve seat 75 is formed at the center of an outer circumferential surface thereof with an opening 75*a* to communicate with the inlet opening 72. The valve seat 75 is designed to be smaller than a spacing between the first and second outlet openings 73 and 74, and is forcibly fitted in the hollow body 71.

The first and second valve members 76 and 77, which are joined to the opposite ends of the connecting rod 78, include first and second thin valve plates 76*a* and 77*a* to be in close contact with the valve seat 75 to block the flow path, and first and second support plates 76*b* and 77*b* coupled to the opposite ends of the connecting rod 78 to support the first and second valve plates 76*a* and 77*a*, respectively. The first and second support plates 76*b* and 77*b* have a diameter corresponding to an internal diameter of the hollow body 71 to be smoothly moved back and forth in the hollow body 71, and have a plurality of through-holes 76*c* and 77*c* to allow air to pass therethrough.

When a compressing operation in the first compressing chamber 31 is carried out, the first and second valve members 76 and 77 connected to the opposite ends of the connecting rod 78 are drawn toward the first outlet opening 73 by suction force acting on the first outlet opening 73, thereby allowing a suction path to be defined at the first outlet opening 73, as illustrated in FIG. 7. At this point, since the valve plate 77*a* of the second valve member 77 closes one end of the valve seat 75, which communicates with the second outlet opening 74, the suction path defined through the second outlet opening 74 is blocked. Since the pressure in the second compressing chamber 32 is transmitted to the second outlet opening 74 of the path-diverting unit 70, the first and second valve members 76 and 77 are moved with a larger force toward the first outlet opening 73.

On the contrary, when a compressing operation in the second compressing chamber 32 is carried out, the first and second valve members 76 and 77, connected to both ends of the connecting rod 78, are drawn toward the second outlet opening 74 by suction force acting on the second outlet opening 74, thereby allowing a suction path to be defined at the second outlet opening 74, as illustrated in FIG. 8. Since the increased pressure in the first compressing chamber 31 is transmitted to the first outlet opening 73 of the path-diverting unit 70, the first and second valve members 76 and 77 are moved with a higher force toward the second outlet opening 74.

That is, the two valve members 76 and 77 are moved toward either the first or second outlet opening 73 or 74, which has an internal pressure lower than that of the other one, due to a pressure difference between the first and second outlet openings 73 and 74, thereby closing the end of the valve seat 75, adjacent to the other outlet opening 74. Consequently, since the inlet opening 72 of the path-diverting unit 70 automatically communicates with the one of the first and second outlet openings 73 and 74, which has a lower internal pressure, a suction path diversion can be easily achieved even without an additional drive unit.

As again shown in FIG. 1, the variable capacity rotary compressor according to the present invention further includes a pressure control unit 80, which creates an internal pressure of the compressing chamber where an idle rotation is being carried out, and an internal pressure of the hermetic casing 10 to be equalized, by applying a discharging pressure to either one of the compressing chambers 31 and 32, where an idle rotation is being carried out. In a conventional rotary compressor, when an internal pressure of a compressing chamber, where an idle rotation is carried out, is lower than that of the hermetic casing 10, a vane pushes an outer surface of an idle rotating-roller piston due to the pressure difference between the compressing chamber and the hermetic casing 10, thereby applying an rotational resistance to the rotating shaft 21. The variable capacity rotary compressor according to the present invention is designed to overcome the above-mentioned conventional problems and to minimize a capacity loss of the rotary compressor by means of the pressure control unit 80. In other words, the pressure control unit 80 equalizes pressure in the hermetic casing 10 and the compressing chamber where an idle rotating operation is carried out.

As shown in FIG. 1, the pressure control unit 80 includes a connecting pipe 81 disposed outside the hermetic casing 10, which communicates with an inside of the hermetic casing 10 at an upper end thereof and extended downward, first and second branch pipes 82 and 83 diverging from the connecting pipe 81 to communicate with the first and second compressing chambers 31 and 32, respectively, and first and second valves 84 and 85 provided at the first and second branch pipes 82 and 83, respectively, to block the paths defined by the first and second branch pipes 82 and 83.

In the pressure control unit 80, when a compressing operation is performed in the first compressing chamber 31, the first valve 84 is closed while the second valve 85 is opened, thereby allowing an internal pressure of the hermetic casing 10 to be applied to the second compressing chamber 32 where an idle rotating operation is carried out. Accordingly, since there is no pressure difference between the hermetic casing 10 and the second compressing chamber 32, the vane 62 does not push the roller piston which is idly rotating. At this point, since the inlet port 64 of the second compressing chamber 32 is closed by an action of the path-diverting unit 70, a phenomenon that fluid in the second compressing chamber 32 flows toward the suction path is prevented. At the same time, high pressure in the second compressing chamber 32 in a state of idle rotation enables the path-diverting unit 70 to operate more smoothly.

On the contrary, when a compressing operation is performed in the second compressing chamber 32, the first valve 84 is opened while the second valve 85 is opened, thereby operating directly opposite to the above-described operation. Consequently, the internal pressure of the first compressing chamber 31 in a state of idle rotation equalizes with the internal pressure of the hermetic casing 10. In this embodiment, the first and second valves 84 and 85 are comprised of electric valves, which operate in response to an electrical signal. Though not shown in the drawing, all the operations of the variable capacity rotary compressor are controlled by a control unit.

Figure 9:
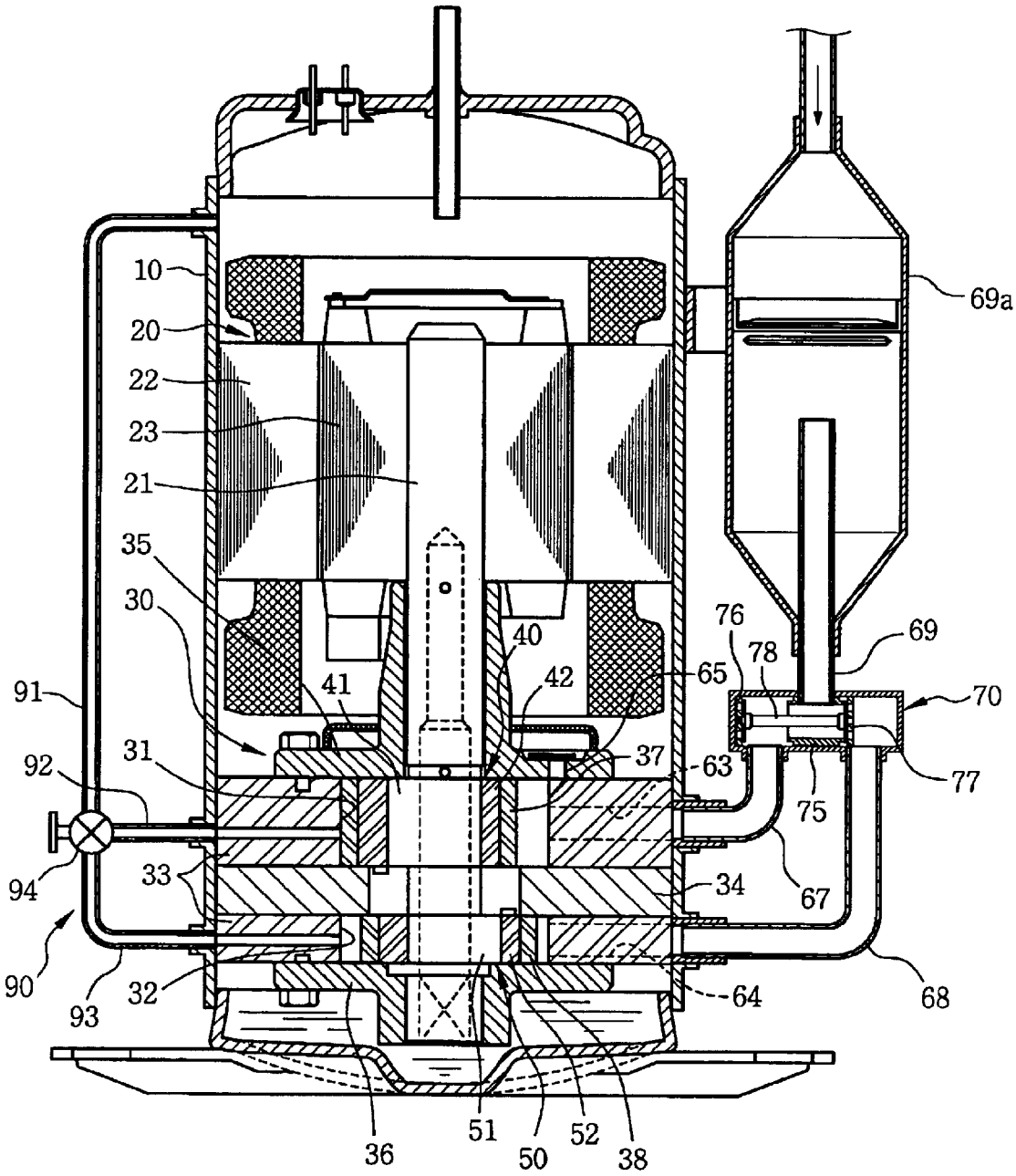
FIG. 9 is a longitudinal cross-sectional view of a variable capacity rotary compressor according to a second embodiment of the present invention.

FIG. 9 shows a variable capacity rotary compressor according to a second embodiment of the present invention, which is provided with a pressure control unit 90 having a construction different from the pressure control unit 80 of the first embodiment. More specifically, the pressure control unit 90 of this second embodiment includes first and second branch pipes 92 and 93 diverging from the connecting pipe 91, and a three-way valve 94 provided at the diverging point of the first and second branch pipes 92 and 93 to perform a path diversion.

When a compressing operation is performed in the first compressing chamber 31, the three-way valve 94 is operated to allow the connecting pipe 91 to communicate with the second branch pipe 93. On the contrary, when a compressing operation is performed in the second compressing chamber 32, the three-way valve 94 is operated to allow the connecting pipe 91 to communicate with the first branch pipe 92. Accordingly, the pressure control unit 90 of this second embodiment can exhibit the same function as that of the pressure control unit 80 of the first embodiment. The three-way valve 94 is comprised of an electric valve, which operates in response to an electrical signal. Though not shown in the drawing, all the operations of the variable capacity rotary compressor are controlled by a control unit. In this second embodiment, other components other than the pressure control unit 90 are constructed in the same manner as those of the first embodiment.

Figure 10:
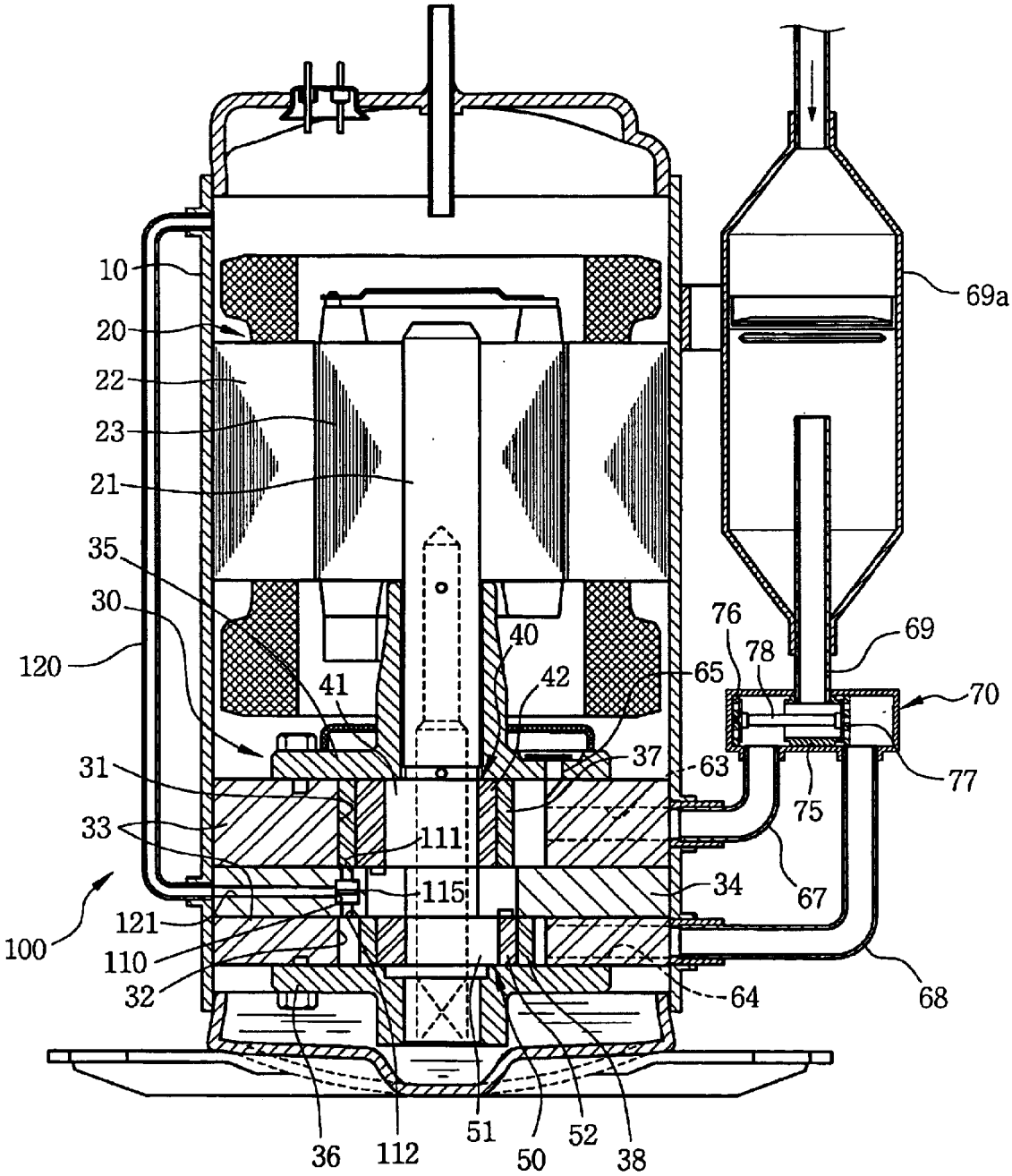
FIG. 10 is a longitudinal cross-sectional view of a variable capacity rotary compressor according to a third embodiment of the present invention.
Figure 11:
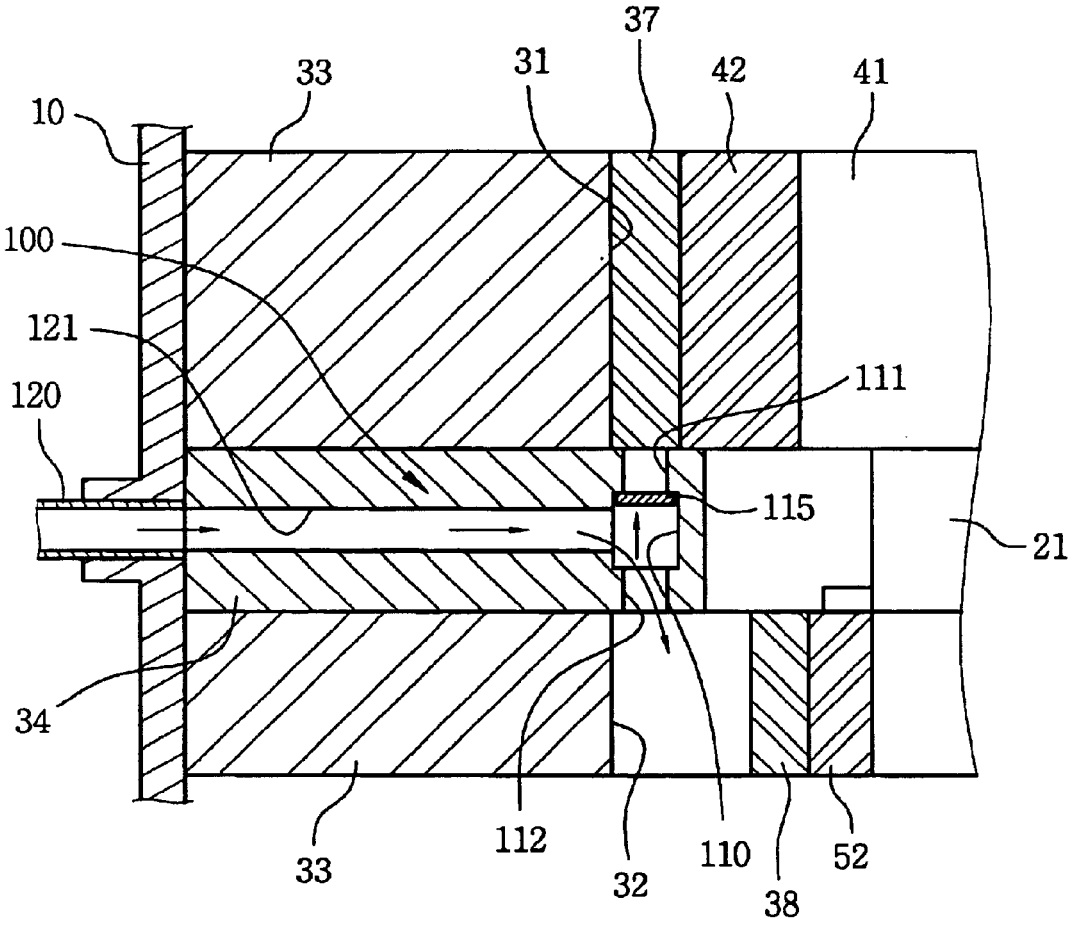
FIG. 11 is a cross-sectional view of a pressure control unit of the variable capacity rotary compressor according to a third embodiment of the present invention, in which a second compressing chamber performs an idle rotating operation.
Figure 12:
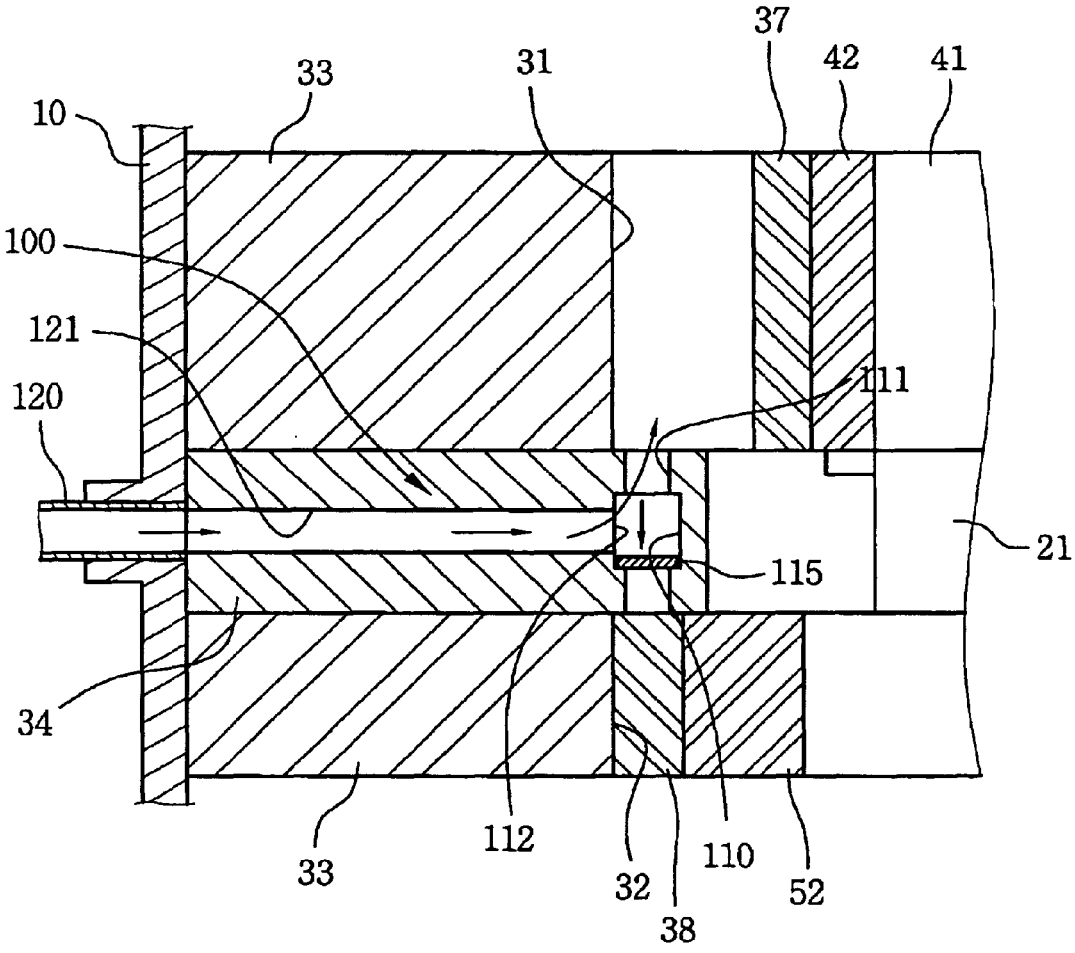
FIG. 12 is a cross-sectional view of a pressure control unit shown in FIG. 11, in which a first compressing chamber performs an idle rotating operation.

FIGS. 10 to 12 show a variable capacity rotary compressor according to a third embodiment of the present invention, which is provided with a pressure control unit 100. The pressure control unit 100 of this third embodiment is constructed to be operated automatically in response to a pressure difference between the first and second compressing chambers 31 and 32, rather than an electrical signal.

As shown in FIG. 11, the pressure control unit 100 includes a communicating path. The communicating path is comprised of a path-diverting chamber 110, which is formed in the intermediate plate 34 interposed between the first and second compressing chambers 31 and 32, and which is provided with upper and lower through-holes 111 and 112 communicating with the first and second compressing chambers 31 and 32, a flow path 121 radially formed in the intermediate plate 34 and communicating with the path-diverting chamber 110, and a connecting pipe 120 to allow the path-diverting chamber 110 to communicate with the inside of hermetic casing 10. The pressure control unit 100 further includes a valve plate 115 movably disposed in the path-diverting chamber 110, which is operated by a pressure difference between the first and second compressing chambers 31 and 32 to close either the upper or lower through-holes 111 or 112, adjacent to the compressing chamber 31 or 32 which performs a compressing operation, while opening the other upper or lower through-holes 111 or 112.

In this third embodiment, diameters of the path-diverting chamber 110 and the valve plate 115 are sized to be larger than those of the upper and lower through-holes 111 and 112 so as to enable the valve plate 115 to close the upper and lower through-holes 111 and 112, and the valve plate 115 is made of a thin resilient plate. The path-diverting chamber 110 and the upper and lower through-holes 111 and 112 are disposed at a position opposite to the first and second vanes 61 and 62, so that the valve plate 115 in the path-diverting chamber 110 is moved toward either the first or second compressing chamber, which currently perform a compressing operation, due to a suction force of the compressing chamber, thereby closing the through-hole communicating with the compressing chamber which performs a compressing operation.

An operation of the pressure control unit 100 according to this third embodiment will now be described.

As shown in FIG. 11, when a compressing operation is carried in the first compressing chamber 31 while an idle rotating operation is carried out in the second compressing chamber 32, the valve plate 115 is moved upward and then closes the upper through-hole 111 communicating with the first compressing chamber 31, due to a pressure difference between the first and second compressing chambers 31 and 32. More specifically, although a pressure in the upper through-hole is increased while the first eccentric roller piston 37 in the first compressing chamber 31 is rotated to the upper through-hole 111 from the first vane 61, a suction force is applied to the upper through-hole 111 of the first compressing chamber 31 from the point at which the first eccentric roller piston 37 passes over the upper through-hole 111. Consequently, the valve plate 115 is moved toward the first compressing chamber 31 and closes the upper through-hole 111 of the first compressing chamber 31. At this point, the lower through-hole 112 of the second compressing chamber 32 opens, and then communicates with the connecting pipe 120. At the same time, discharging fluid increases the internal pressure in the hermetic casing 10, and the internal pressure is transmitted to the second compressing chamber 32 via the connecting pipe 120 and the path-diverting chamber 110. Since there is a pressure difference between the first and second compressing chambers 31 and 32 after a few revolutions of the roller piston, the upper through-hole 111 of the first compressing chamber 31 remains closed by the valve plate 115. In the meantime, since the second compressing chamber 32, which performs an idle rotating operation, maintains a pressure equal to a pressure in the hermetic casing 10, the second vane 62 does not push the second roller piston 38, which is idly rotated, thereby allowing a smoother rotation of the rotating shaft 21.

As shown in FIG. 12, when a compressing operation is carried in the second compressing chamber 32 while an idle rotating operation is carried in the first compressing chamber 31, the valve plate 115 is moved toward the second compressing chamber 32, and then closes the lower through-hole 112 communicating with the second compressing chamber 32, due to the above-described pressure difference between the first and second compressing chambers 31 and 32. At this point, the upper through-hole 111 of the first compressing chamber 31 opens and then communicates with the connecting pipe 120. Consequently, since the first compressing chamber 31 maintains a pressure equal to that in the hermetic casing 10, the first vane 61 does not push the first roller piston 37, which is idly rotated, thereby allowing a smoother rotation of the rotating shaft 21.

As is apparent from the above description, the present invention provides a variable capability rotary compressor, which is constructed to selectively perform a compressing operation in only one of two compressing chambers having different capacities, depending on a rotating direction of its rotating shaft, in order to easily perform and to precisely control the variation of a compression capability into a desired discharge pressure.

Furthermore, since an internal pressure in a hermetic casing is applied to either one of the two compressing chambers, which currently performs an idle rotating operation, by means of a pressure control unit, there is no internal pressure difference between the hermetic casing and the compressing chamber performing the idle rotating operation. Accordingly, the variable capacity rotary compressor according to the present invention can solve the problem that a vane in the compressing chamber performing the idle rotating operation pushes a roller piston and thus generates a resistance to rotation of a rotating shaft, and thus can minimize the loss of capacity, thereby improving capacity of the rotary compressor.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A variable capacity rotary compressor, comprising:

a hermetic casing;

a housing disposed in the hermetic casing and including first and second compressing chambers having different capacities;

a rotating shaft rotatably disposed in the first and second compressing chambers;

first and second eccentric units mounted on an outer surface of the rotating shaft in the first and second compressing chambers, respectively, the first and second eccentric units being operated in opposite manners such that when either the first or second eccentric unit is locked in an eccentric state to perform a compressing operation, the other eccentric unit is released from the eccentric state to release the compressing operation;

first and second roller pistons fitted on outer surfaces of the first and second eccentric units, respectively;

first and second vanes provided in the first and second compressing chambers to be radially moved while being in contact with the first and second roller pistons, respectively; and a pressure control unit to allow a discharging pressure to be applied to either the first or second compressing chamber, where an idle rotating operation is performed.

2. The variable capacity rotary compressor as set forth in claim 1, wherein the pressure control unit comprises:

first and second flow paths communicating with the first and second compressing chambers to allow a discharging pressure to be applied to either the first or second compressing chamber, where an idle rotating operation is performed; and first and second valves provided at the first and second flow paths to open and close the flow paths.

3. The variable capacity rotary compressor as set forth in claim 2, wherein the pressure control unit further includes a connecting pipe provided outside the hermetic casing to communicate with an inside of the hermetic casing, and the first and second flow paths are defined by first and second branch pipes diverging from the connecting pipe, the first and second valves being provided at the first and second branch pipes.

4. The variable capacity rotary compressor as set forth in claim 1, wherein the pressure control unit comprises:

a connecting pipe provided outside the hermetic casing to communicate with an inside of the hermetic casing;

first and second branch pipes diverging from the connecting pipe and communicating with the first and second compressing chambers; and a three-way valve provided at a diverging point where the first and second branch pipes diverge from the connecting pipe.

5. The variable capacity rotary compressor as set forth in claim 1, wherein the housing includes an intermediate plate to isolate the first and second compressing chambers from each other, and wherein the pressure control unit comprises:

a path-diverting chamber formed in the intermediate plate and having first and second through-holes communicating with the first and second compressing chambers;

a communicating path to allow an inside of the hermetic casing to communicate with the path-diverting chamber; and a valve piece disposed in the path-diverting chamber and operated by a pressure difference between the first and second compressing chambers to close either the first or second through-hole where a compressing operation is performed while opening the other through-hole.

6. The variable capacity rotary compressor as set forth in claim 5, wherein the communicating path comprises:

a connecting pipe extended from the hermetic casing to communicate with an inside of the hermetic casing; and a flow path radially formed in the intermediate plate to be connected between the path-diverting chamber and the connecting pipe.

7. The variable capacity rotary compressor as set forth in claim 5, wherein the first and second through-holes of the path-diverting chamber are provided at a position opposite to the first and second vanes.

8. The variable capacity rotary compressor as set forth in claim 5, wherein diameters of the path-diverting chamber and the valve piece are larger than those of the upper and lower through-holes so as to enable the valve piece to close the upper and lower through-holes.

9. The variable capacity rotary compressor as set forth in claim 8, wherein the valve piece is made of a thin resilient plate.

10. The variable capacity rotary compressor as set forth in claim 1, further comprising a path-diverting unit to allow refrigerant to be drawn into either one of inlet ports of the first and second compressing chambers, where a compressing operation is performed.

11. The variable capacity rotary compressor as set forth in claim 10, wherein the path-diverting unit comprises:

a hollow body having a predetermined length and closed at opposite ends thereof;

an inlet opening provided at the center of the hollow body;

first and second outlet openings provided at the side opposite to the inlet opening with a spacing therebetween, and communicating with the inlet ports of the first and second compressing chambers, respectively;

a hollow valve seat disposed in the hollow body to communicate with the inlet opening and having opposite ends communicating with the first and second outlet openings; and first and second valve members movably disposed in the hollow body to close the opposite ends of the hollow valve seat, and connected to each other by a connecting member.

12. The variable capacity rotary compressor as set forth in claim 11, wherein the first and second valve members are moved toward either the first or second outlet openings, which has a pressure lower than that of the other outlet opening, due to a pressure difference between the first and second outlet opening, so that a corresponding one of the first or second valve member closes one end of the valve seat adjacent to the other outlet opening with a higher pressure, thereby allowing the inlet opening of the hollow body to communicate with the one outlet opening with lower pressure.

13. The variable capacity rotary compressor as set forth in claim 1, wherein each of the first and second eccentric units comprises:

an eccentric cam provided on the rotating shaft;

an eccentric bush rotatably fitted on an outer surface of the eccentric cam, a corresponding one of the first and second roller pistons being fitted on an outer surface of the eccentric bush; and a stop unit to cause the eccentric bush to be maintained in an eccentric state.

14. The variable capacity rotary compressor as set forth in claim 13, wherein the stop unit includes a first stop element projected from the eccentric cam, and a second stop element protruded from the eccentric bush to be caught by the first stop element.

15. A variable capacity rotary compressor comprising:

a housing including first and second compressing chambers having different capacities;

a rotating shaft rotatably disposed in the first and second compressing chambers;

first and second roller pistons provided on an outer surface of the rotating shaft to be locked in an eccentric state or to be released from the eccentric state depending on a rotating direction of the rotating shaft;

first and second vanes disposed in the first and second compressing chambers to be radially moved while being in contact with the first and second roller pistons; and a pressure control unit to allow a discharging pressure to be applied to either the first or second compressing chamber, where an idle rotating operation is performed.

16. A variable capacity rotary compressor comprising:

a hermetic casing;

a housing disposed in the hermetic casing and including first and second compressing chambers having different capacities;

a rotating shaft rotatably disposed in the first and second compressing chambers;

first and second roller pistons provided on an outer surface of the rotating shaft to be locked in an eccentric state or to be released from the eccentric state depending on a rotating direction of the rotating shaft;

first and second vanes disposed in the first and second compressing chambers to be radially moved while being in contact with the first and second roller pistons;

first and second communicating paths to allow the first and second compressing chambers to communicate with an inside of the hermetic casing; and a valve to allow a discharging pressure to be applied to either the first or second compressing chamber, where an idle rotating operation is performed.

17. A variable capacity hermetically sealed rotary compressor, including first and second compressing chambers in which first and second compressing operations are carried out, respectively, and a shaft to rotate in first and second directions in the compressing chambers, comprising:

first and second eccentric units mounted on the shaft in the first and second compressing chambers, respectively, such that when the shaft rotates in the first direction the first eccentric unit performs a first compressing operation, and when the shaft rotates in the second direction, the second eccentric unit performs a second compressing operation;

first and second roller pistons fitted on the first and second eccentric units, respectively, to rotate eccentrically when the respective eccentric unit performs the respective compressing operation and to rotate idly when the other respective eccentric unit performs the respective compressing operation; and a pressure control unit to allow a discharging pressure to be applied to either the first or second compressing chamber, where the respective idle rotating operation is performed.

18. The compressor according to claim 17, further comprising a path diverting unit comprising:

a cylindrical hollow valve seat having both ends open;

first and second valve members movably disposed in the valve seat to open and close the cylindrical hollow valve seat; and a connecting rod between the first and second valve members which are joined thereto.

19. The compressor according to claim 18, wherein the path diverting unit further comprises:

an inlet of a suction pipe from an accumulation chamber, and first and second outlet openings leading to the first and second compressing chambers, respectively, wherein the valve seat is formed at the center of an outer circumferential opening thereof, to communicate with the inlet, having a length that is shorter than a length between the outlet openings.

20. The compressor according to claim 19, wherein the first and second valve plates have a diameter corresponding to an internal diameter of the hollow body to be smoothly moved in the hollow body, and have a plurality of through holes to allow air to pass therethrough.

21. The compressor according to claim 20, wherein the first and second valve members are moved toward either the first or second outlet openings, which has an internal pressure lower than the other outlet opening, thereby closing the valve seat, adjacent the other opening.

22. The compressor according to claim 17, wherein the pressure control unit comprises:

a connecting pipe outside the hermetically sealed compressor which communicates with an inside of the hermetically sealed compressor at an upper end thereof and extends downward;

first and second branch pipes diverging from the connecting pipe to communicate with the first and second compressing chambers, respectively; and first and second valves in the first and second pipes, respectively, to block the first and second pipes.

23. The compressor according to claim 22, wherein when a compressing operation is performed in the first compressing chamber the first valve of the pressure control unit is closed while the second valve of the pressure control unit is opened, thereby allowing an internal pressure of the hermetically sealed compressor to be applied to the second compressing chamber.

24. The compressor according to claim 23, wherein when a compressing operation is performed in the second compressing chamber the second valve of the pressure control unit is closed while the first valve of the pressure control unit is opened, thereby allowing an internal pressure of the hermetically seated compressor to be applied to the first compressing chamber.

25. The compressor according to claim 17, wherein the pressure control unit comprises:

a connecting pipe outside the hermetically sealed compressor which communicates with an inside of the hermetically sealed compressor at an upper end thereof and extends downward;

first and second branch pipes diverging from the connecting pipe to communicate with the first and second compressing chambers, respectively; and a three way valve at the diverging point of the first and second branch pipes, to selectively block the first and second pipes.

26. The compressor according to claim 25, wherein when a compressing operation is performed in the first compressing chamber the three way valve allows the connecting pipe to communicate with the second branch pipe.

27. The compressor according to claim 26, wherein when a compressing operation is performed in the second compressing chamber the three way valve allows the connecting pipe to communicate with the first branch pipe.

28. The compressor according to claim 25, wherein the three way valve comprises an electric valve that operates in response to an electric signal.

29. The compressor according to claim 17, wherein the pressure control unit comprises:

a communicating path in an intermediate plane between the first and second compressing chambers, including a path diverting chamber having upper and lower through holes to communicate with the first and second compressing chambers;

a flow path radially formed in the intermediate plane to communicate with the path diverting chamber; and a connecting pipe to allow the path diverting chamber to communicate with the inside of the hermetically sealed rotary compressor.

30. A variable capacity hermetically sealed rotary compressor, comprising:

first and second compressing chambers, in which one of a first set of a first compressing operation and a second idling operation are performed, and second set of a first idling operation and a second compressing operation are performed, respectively;

a shaft to rotate in first and second directions to selectively induce the respective first and second compressing operations and the first and second idling operations, a pressure control unit to apply a discharging pressure to either the first or second compressing chamber, where the respective idle rotating operation is performed.

* * * * *